US005477919A

United States Patent [19]

Karube

[11] Patent Number: 5,477,919

[45] Date of Patent: Dec. 26, 1995

[54] HEAT EXCHANGER

[75] Inventor: Toshikatsu Karube, Oyamashi, Japan

[73] Assignee: Showa Aluminum Corporation, Osaka, Japan

[21] Appl. No.: 133,962

[22] Filed: Oct. 7, 1993

[30] Foreign Application Priority Data

Oct. 12, 1992 [JP] Japan ..... 4-272705

[51] Int. Cl.[6] ..... F28F 9/04

[52] U.S. Cl. ..... 165/176; 165/178; 285/137.1

[58] Field of Search ..... 165/173–176, 165/153, 178; 285/137.1, 26, 29

[56] References Cited

U.S. PATENT DOCUMENTS

| | | | |
|---|---|---|---|
| 4,957,158 | 9/1990 | Ando | 165/110 |
| 5,022,464 | 6/1991 | Aoki et al. | 165/176 X |
| 5,095,972 | 3/1992 | Nakaguro | 165/176 X |
| 5,163,716 | 11/1992 | Bolton et al. | 165/173 X |
| 5,170,841 | 12/1992 | Briet | 165/178 X |
| 5,174,373 | 12/1992 | Shinmura | 165/176 |
| 5,228,727 | 7/1993 | Tokutake et al. | 165/178 X |
| 5,240,068 | 8/1993 | Tokutake | 165/173 X |

FOREIGN PATENT DOCUMENTS

| | | | |
|---|---|---|---|
| 64-31369 | of 0000 | Japan . | |
| 63-87477 | of 0000 | Japan . | |
| 84395 | 4/1991 | Japan | 165/150 |
| 79994 | 4/1991 | Japan | 165/173 |

*Primary Examiner*—Leonard R. Leo

[57] ABSTRACT

A heat exchanger has tubes and headers, with each tube having both ends connected to the headers in fluid communication. A blockish joint of the flange connection type is attached to one header, and an inlet port and an outlet port are formed in the joint. One or two blockish connectors also of the flange connection type and fixed to ends of external pipings are connected to the joint, such that an effective core area of the heat exchanger is increased, and an operation for connecting the external pipings is rendered simpler and more efficient.

16 Claims, 16 Drawing Sheets

HEAT EXCHANGER

BACKGROUND OF THE INVENTION

1. Field of the Invention

The present invention relates to a heat exchanger, and more particularly, to a heat exchanger adapted for use as a condenser, an evaporator or the like employed in the car air conditioners or room air conditioners.

2. Prior Art

Heat exchangers of the so-called multi-flow or parallel flow types are widely used for example as the condensers in the car air conditioners. Each heat exchanger of such types generally comprises a body which is composed of flat tubes arranged parallel at regular intervals and a pair of left-hand and right-hand hollow headers. The headers are disposed close to ends of the tubes which are connected to the headers in fluid communication. It has been a common practice to connect an inlet pipe for supplying the body with a heat exchanging medium to one of the headers, with an outlet pipe for discharging the medium being connected to the other header. Joints of the so-called flared connection type have been secured to the ends of such an inlet and outlet pipes.

Thus, the inlet and outlet pipes for charging or discharging the medium have independently been connected to the respective headers, so that a space large enough to receive the heat exchanger inclusive of the pipes must be provided in an automobile body or the like object. Therefore, the heat exchanger body must be designed considerably small. In addition, the inlet and outlet pipes must be arranged in the automobile body in such a state that other adjacent devices or the like thereon would not interfere with said pipes. This often has undesirably resulted in a complicated, for example repeatedly bent, configuration of those pipes.

It also has been a problem that the joints of flared connection type, which are attached to the ends of the inlet and outlet pipes, necessitate union nuts which must be driven to rotate around each pipe end and a mating end of each external piping. This is an intricate operation and needs much labor.

On the other hand, a blockish joint of the flange type for connection of the inlet and outlet pipes to the heat exchanger has been proposed in the U.S. Pat. No. 4,957,158 issued on Sep. 18, 1990. According to this proposal, two blockish joints are employed and one of them is attached to an upper end of the left-hand header, with another joint being attached to a lower end of the right-hand header. Each such joint comprises an inlet or outlet port for the heat exchanging medium, so that any intermediate short pipes are not necessary for the external pipings to be connected to the joints.

This proposal is advantageous in that any excessively large space is no longer required to the automobile body or the like, in contrast with the case wherein those pipes are directly connected to a heat exchanger body. Consequently, not only an effective area thereof can be increased, but also external pipings can be connected easily and in an efficient manner for example by fastening bolts or the like members.

It however has been observed that a considerable number of parts are undesirably needed to employ the system in accordance with that proposal. The operation for connection of one external piping to the inlet has to be done at a region different from that at which connection of the other piping is made to the outlet, thus causing much and intricate labor.

OBJECTS AND SUMMARY OF THE INVENTION

Therefore, it is an object of the present invention to provide a heat exchanger comprising a body, which can have a larger effective area and to which external pipings can be connected easily in an efficient manner.

Another object is to provide a heat exchanger to which external pipings can be connected at the same position so that the operation for connection of the pipings can be done much easier and more efficiently.

In order to achieve these objects, a heat exchanger provided in accordance with the present invention does essensially comprise: a plurality of tubes; at least one header to which an end of each tube is connected in fluid communication; and a blockish joint of flange connection type and having a flat side formed with an inlet port and an outlet port for flowing a heat exchanging medium, wherein the joint is attached to the header in fluid communication therewith.

The joint provided herein to receive the external pipings is directly adjoined to the header. Thus, any complicated intermediate pipes which are exposed between the joint and the header so as to charge and discharge the heat exchanging medium in the prior art heat exchangers can now be dispensed with. Consequently, an effective core area of the heat exchanger can now be made larger.

Since the joint is a block-shaped member and is of the flange connection type, the external pipings can easily and readily be connected to the joint for example by fastening a bolt or the like.

The joint which has the inlet and outlet ports for the heat exchanging medium reduces the number of parts of the heat exchanger as a whole. Besides, such a joint makes it possible to more easily and readily connect both the external pipings to the same position of the heat exchanger.

Since the joint comprising the inlet and outlet ports is directly attached to the header in fluid communication, the number of connection necessary between relevant parts and members is reduced herein, thereby diminishing the possibility of undesirable leakage of the heat exchanging medium.

Other objects and advantages of the present invention will become apparent from the preferred embodiments which are described below referring to the drawings.

The present invention can however be embodied in any modes and manners other than those proposed in the preferred embodiments and examples, without departing from its spirit and scope. In other words, those embodiments are not restrictive but merely exemplifies the best mode which is defined not solely in the specification but more exactly in the accompanying claims. Any modified or altered features equivalent to those given in the claims must not be regarded as any deviation from the present invention.

BRIEF DESCRIPTION OF THE DRAWINGS

FIGS. 1 to 7 show a first embodiment of the invention, in which:

FIG. 1 is a front elevation of a heat exchanger as a whole provided in the first embodiment;

FIG. 2 is a plan view of the heat exchanger;

FIG. 3 is a left-hand elevation of the heat exchanger;

FIG. 4 is an enlarged cross section of a joint included in the heat exchanger and connected to a header thereof;

FIG. 5 is a cross section taken along the line 5—5 in FIG. 3;

FIG. 6 is a perspective view showing, in their disassembled state, the header, tubes, a partition, seats, the joint, external pipings and connectors attached to ends of the pipings; and FIG. 7 is a diagram illustrating the flow of a heat exchanging medium through the heat exchanger;

FIGS. 8 to 13 show a second embodiment of the invention, in which:

FIG. 8 is a front elevation of a heat exchanger as a whole provided in the second embodiment;

FIG. 9 is a plan view of the heat exchanger;

FIG. 10 is a right-hand elevation of the heat exchanger;

FIG. 11 is an enlarged cross-section of a joint included in the heat exchanger and connected to a header thereof;

FIG. 12 is a plan view of a partition secured in the header; and

FIG. 13 is a diagram illustrating the flow of a heat exchanging medium through the heat exchanger;

FIGS. 16 to 22 show a fifth embodiment of the invention, in which:

FIG. 16 is a front elevation of a heat exchanger as a whole provided in the fifth embodiment;

FIG. 17 is a plan view of the heat exchanger;

FIG. 18 is a left-hand elevation of the heat exchanger;

FIG. 19 is a vertical cross-section of a header included in the heat exchanger;

FIG. 20 is a cross-section of a joint which is seen from its left-hand side and also included in the heat exchanger, wherein a connector attached to external pipings is coupled with the joint;

FIG. 21 is a perspective view of a partition fitted on an internal pipe insertable in the header; and FIG. 22 is a diagram illustrating the flow of a heat exchanging medium through the heat exchanger.

DETAILED DESCRIPTION OF THE PREFERRED EMBODIMENTS

First Embodiment

The invention will now be described in more detail referring to an embodiment which provides a condenser as an example of heat exchangers made of aluminum and being of the so-called multi-flow type. The condenser is adapted for use in car air conditioners.

Figure 1:
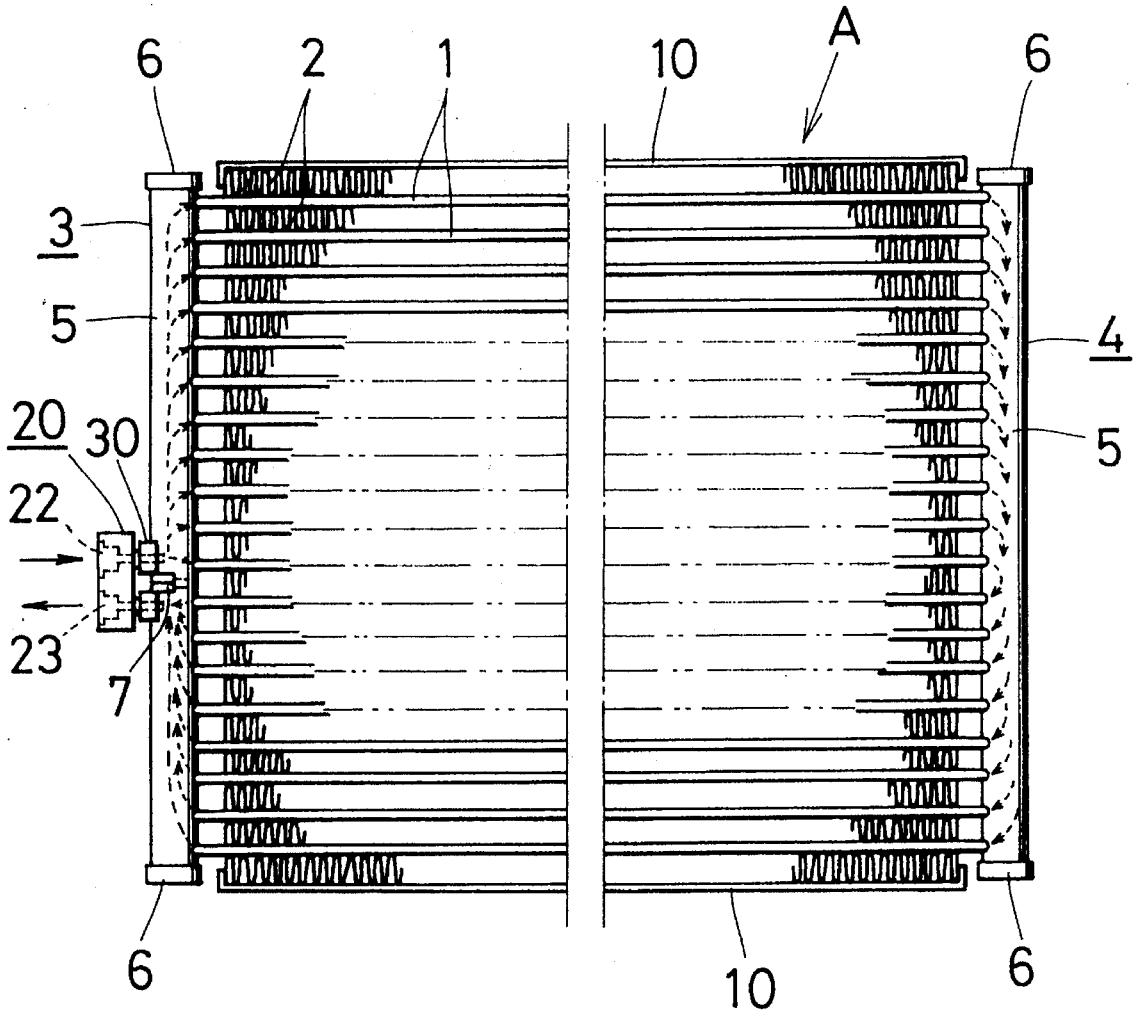
Figure 2:
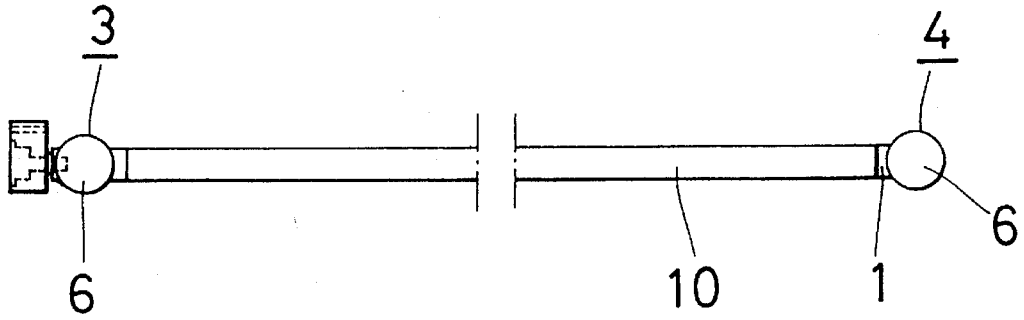
Figure 3:
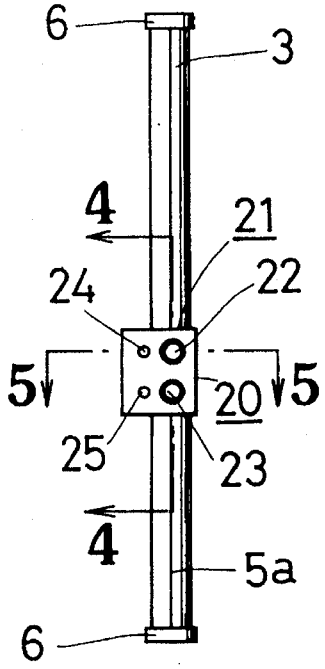

The reference symbol "A" in FIG. 1 denotes a heat exchanger body. This body "A" comprises a plurality of flat aluminum tubes 1 which are arranged horizontally one above another. The heat exchanger body further comprises a plurality of corrugated aluminum fins 2 each disposed between the adjacent tubes 1 or outside the outermost ones 1, and a pair of left- and right-hand headers 3 and 4 each disposed close to and in fluid communication with ends of the tubes 1.

Each tube 1, which usually is a flat and hollow piece made by extruding aluminum, is multi-bored due to longitudinal partitions 1*a* which improve its pressure resistance and heat conductivity. Those tubes 1 are called "harmonica tubes". However, seam-welded tubes may take place of the extruded tubes, and may similarly have longitudinal partitions such as corrugated internal fins. Alternatively, a plane sheet may be roll-formed to give a tube which also has internal partitions, as disclosed in the U.S. Pat. No. 5,186,250 issued to Ouchi et al. on Feb. 16, 1993, the teachings of which are hereby incorporated by reference. Any tubes of other types shown in this U.S. Pat. No. 5,186,250 may be employed in the present invention.

The corrugated fins 2 are strips made of a brazing sheet and substantially of the same width as the tubes, and bent in a meandering manner. The brazing sheet is composed of an aluminum core having both sides covered with a brazing agent layer. The fins 2 are brazed to tubes 1 by means of this brazing agent. Preferably, each fin 2 has louvers 2*a* opened up through the strip for a higher efficiency of heat exchange. Plate fins of a certain type which has slots formed at regular intervals along one of its edges may substitute for the corrugated fins. In this case, the plate fins are disposed perpendicular to the tubes and at regular intervals so that the tubes are inserted in the corresponding slots.

Each of the left- and right-hand headers 3 and 4 comprises a cylindrical header pipe 5 having an upper and lower ends closed with aluminum caps 6. This header pipe 5 also is made of a brazing sheet which is composed of an aluminum core having both sides covered with the brazing agent layer. The brazing sheet having opposite edges is curved so that the edges 5*a* abut against each other and are brazed one to another due to the brazing agent. The pipe 5 thus formed round in cross-section is highly resistant to pressure. Details of such a pipe is disclosed in the U.S. Pat. No. 4,945,635 issued to Nobusue et al. on Aug. 7, 1990, the teachings of which are hereby incorporated by reference. Any pipe not round in cross-section may substitute for the round header pipe, if it withstands well an internal pressure imparted thereto in use. Further, a seam-welded pipe, a composite pipe composed of adjoined halves or an extruded seamless pipe may be employed in place of the round header pipe. One of the halves of the composite pipe has apertures to receive the tube ends and has opposite longitudinal edges brazed to corresponding edges of the other half. The caps 6 having upright walls cover the ends of the header pipe 5 with the upright walls disposed in close contact with the outer surface of the header pipe. Those upright walls and the outer surface are tightly brazed one to another due to the brazing agent. The caps prevent the pipe from expanding when the abutting edges 5*a* thereof are brazed one to another, so that any jig or special tool is no longer needed for this purpose. Further, the caps 6 contribute to improve pressure resistance of the pipe 5. Aluminum alloys included in the 7N01 series or 7000 low-Mg series are preferable to fabricate the caps, from the viewpoint of brazeability and mechanical strength of the header caps 6.

A row of apertures 5*b* as circumferential slots are formed in the periphery of each header pipe 5 so as to receive the ends of tubes 1. The tubes whose ends are inserted in those apertures 5*b* are liquid-tightly brazed to the header pipes 5.

A partition 7, which is secured in the left-hand header 3 slightly below its middle height, divides the interior thereof into an upper and lower compartments. This partition 7 is inserted in the header 3 through a peripheral slit 3*a* thereof, and comprises folded plates 8 and 9 which are integral at their inner ends. Outer arcuate ends 8*a* and 9*a* of the partitioning plates are in close contact with and brazed to a lip of the header's aperture 3*a*. Such a partition is disclosed in the U.S. Pat. No. 5,123,483 issued to Tokutake et al. on Jun. 23, 1992, the teachings of which are hereby incorporated by reference. Any partitions of other types shown in this patent may be employed in the present invention.

The partition 7 separates an upper group of passageways from a lower group of them for a heat exchang medium.

Side plates 10 which are aluminum strips substantially of the same width as the fins are disposed outside the outermost fins 2.

A joint 20 for an inlet and outlet for the heat exchanging medium is fixedly attached to the left-hand header 3.

The joint 20 is a block made of aluminum, and comprises a joint body 21 which substantially is a rectangular parallelepiped having a flat side 21*a* for flange connection. An inlet port 22 and an outlet port 23 for the heat exchanging medium are formed through an upper portion and a lower portion of the body, respectively, both opening on the flat side 21*a*. Two female-threaded bores 24 and 25 penetrate said body from the flat surface 21*a* for flange connection. Insertable short pipes 26 and 27 protrude from another side opposite to the flat flange connection side 21*a* of the body 21. The short pipes 26 and 27 are fabricated separate from the joint body 21 and liquid-tightly brazed thereto. Those short pipes are respectively in alignment with the inlet and outlet ports 22 and 23. The short pipes communicate with the ports respectively through internal passages 28 and 29. Basal ends 26*a* and 27*a* of the joint body 21 are diametrically enlarged as compared with the insertable portions of the short pipes. The joint 20 may be an integral block which comprises the joint body 21 and the short pipes 26 and 27.

A pair of openings 3*b* and 3*c* are formed through the outer peripheral portions of the left-hand header 3. One of them is located above the partition 7, with the other below same it so as to correspond to the insertable short pipes 26 and 27. Seats 30 are disposed each between the outer surface of the header and each of short pipe 26 and 27 of the joint 20 inserted in the openings 3*b* and 3*c*, respectively. Those short pipes in this state are liquid-tightly brazed to the header. Each seat 30 has an inner face concaved in conformity with the peripheral surface of the header, and an outer face flattend to be in close contact with an inner surface of the enlarged basal portion of 26*a* or 27*a* of each short pipe. A central hole 30*a* through the seat fits on the outer periphery of each inserted short pipe 26 or 27. Those seats 30 are pressed pieces of a composite material which is composed of a core having both sides covered with the brazing agent layer, as disclosed in the U.S. Pat. No. 5,228,727 issued to Tokutake et al. on Jul. 20, 1993, the teachings of which are incorporated by reference.

The upper and lower compartments, which are separated from one another by the partition 7 secured in the header 3, are in fluid communication with the inlet port 22 and outlet port 23 of the joint 20, respectively via the internal passages 28 and 29.

Figure 4:
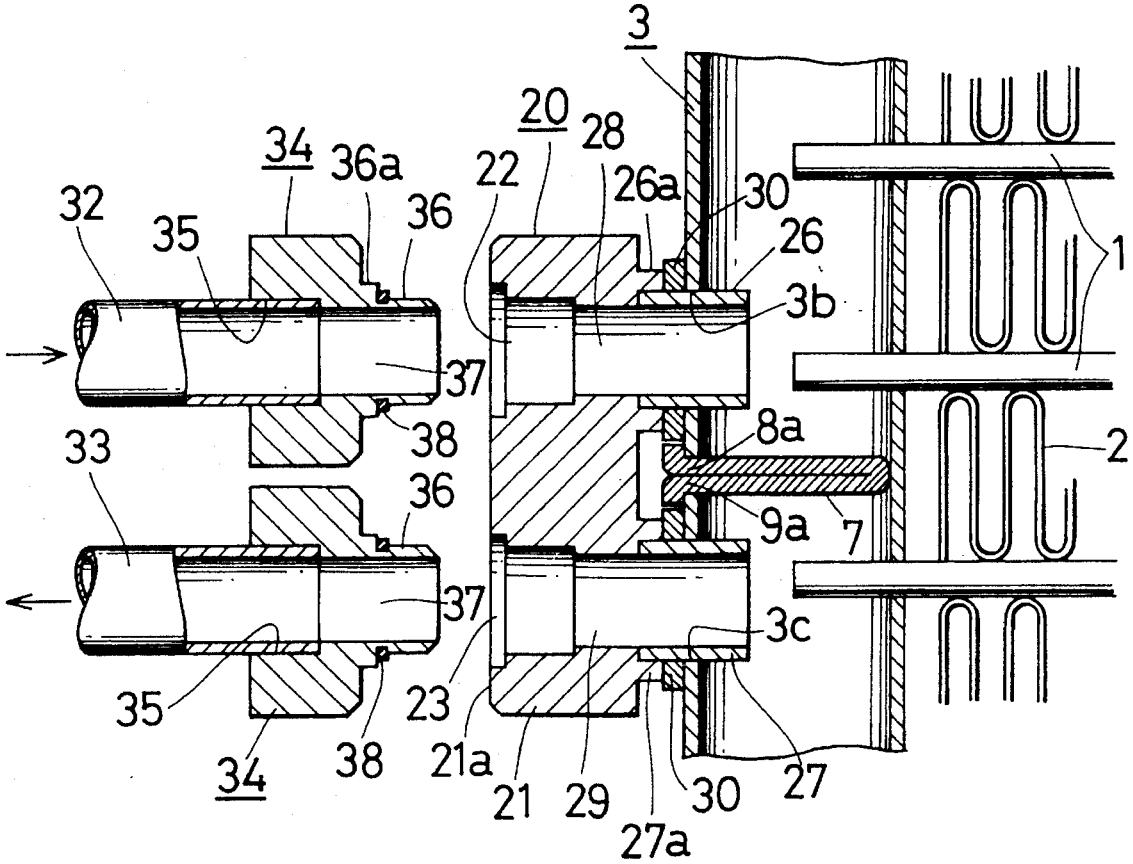
Figure 5:
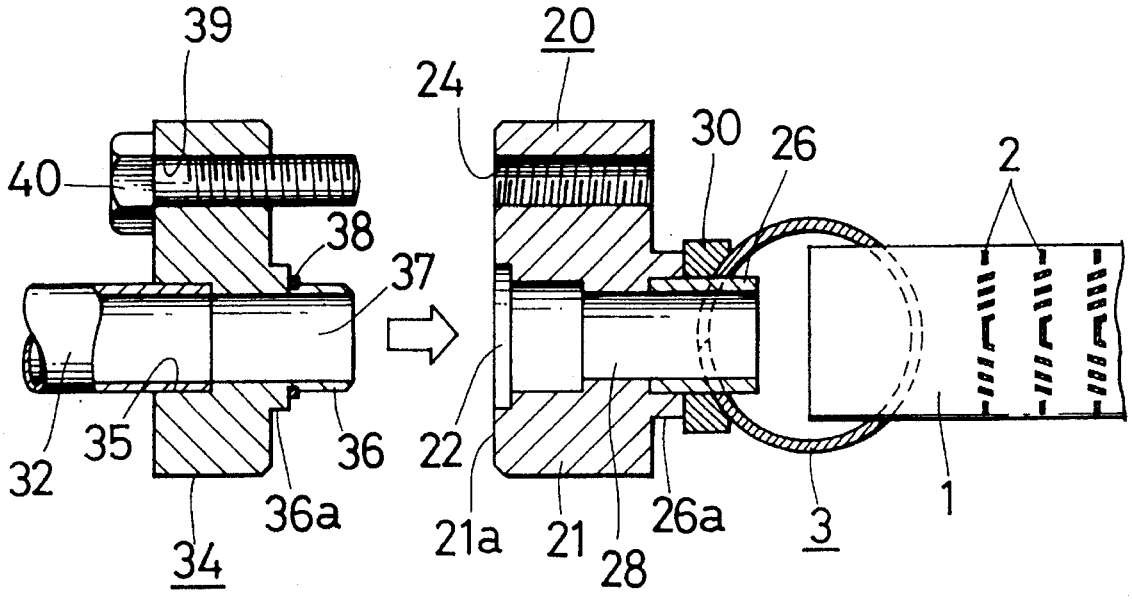
Figure 6:
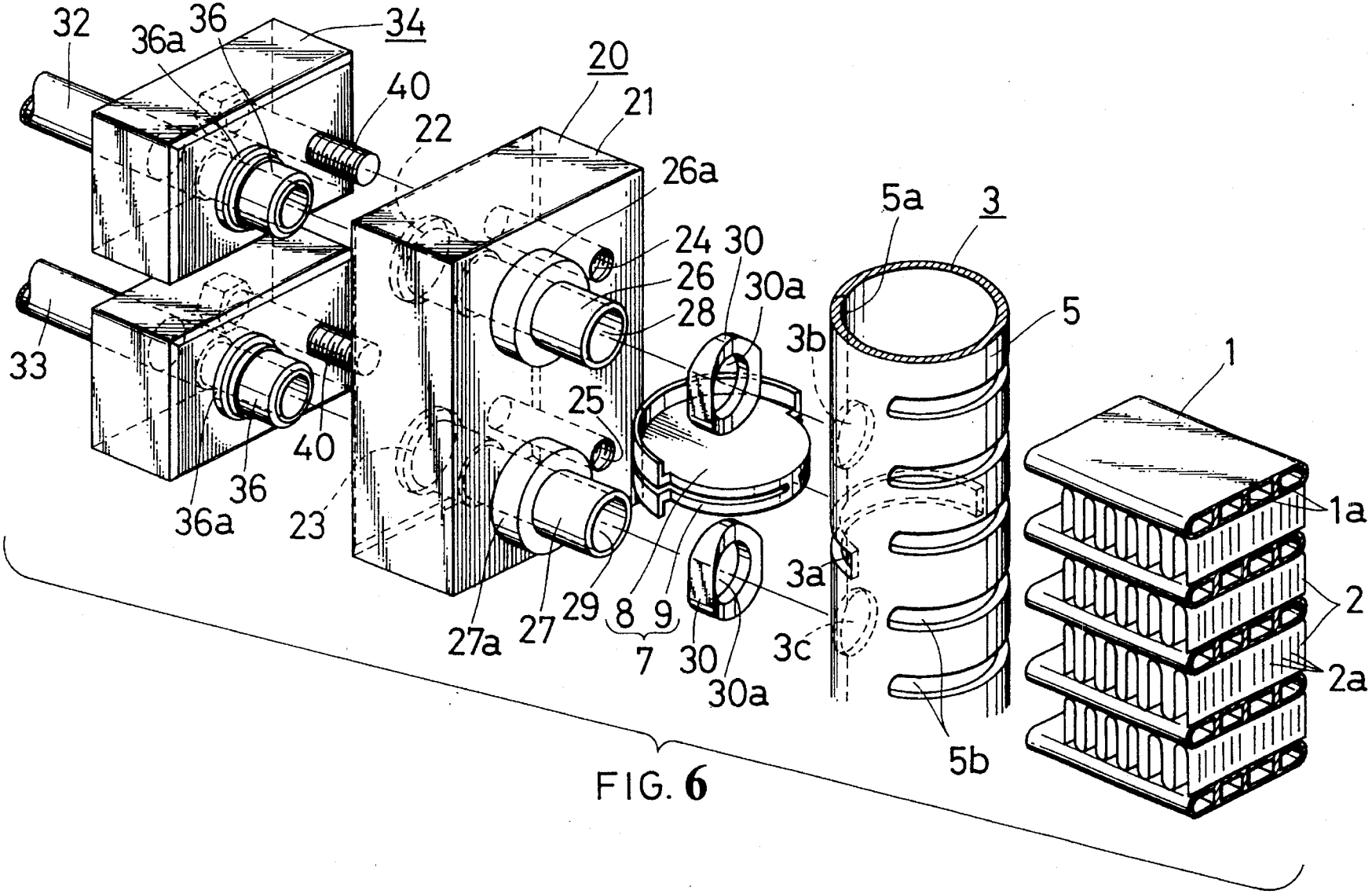

Two connectors 34 of flange connection type are fixed on ends of respective external pipings 32 and 33, so that these pipings can be attached to the joint 20, in a manner shown in FIGS. 4 to 6.

The connectors 34 are not integral with each other, but each of them is an one-piece fabricated aluminum block. A receiving port 35 is formed on one side of each connector 34, so that the end of external piping 32 or 33 is forced tight into this port. Alternatively, the ends of those external pipings may be brazed to, welded to or otherwise fixed in the receiving ports. A short cylindrical protrusion 36 is formed integral with the other side of each connector. A basal end 36*a* of this protrusion is of such an enlarged diameter as fitting in the inlet port 22 or outlet port 23 of the joint 20. A seal ring 38 mounted on the protrusion 36 and in front of the basal end seals up a clearance between the port and the basal end. The receiving port 35 is in fluid communication with the protrusion 36 through an internal passage 37. A non-threaded bore 39 formed through this connector 34 is aligned with the female-threaded bore 24 or 25 in the joint 20. Thus, a bolt 40 is inserted in the former bore and screwed into the latter bore to thereby fasten the connector 34 to the joint 20.

Figure 7:
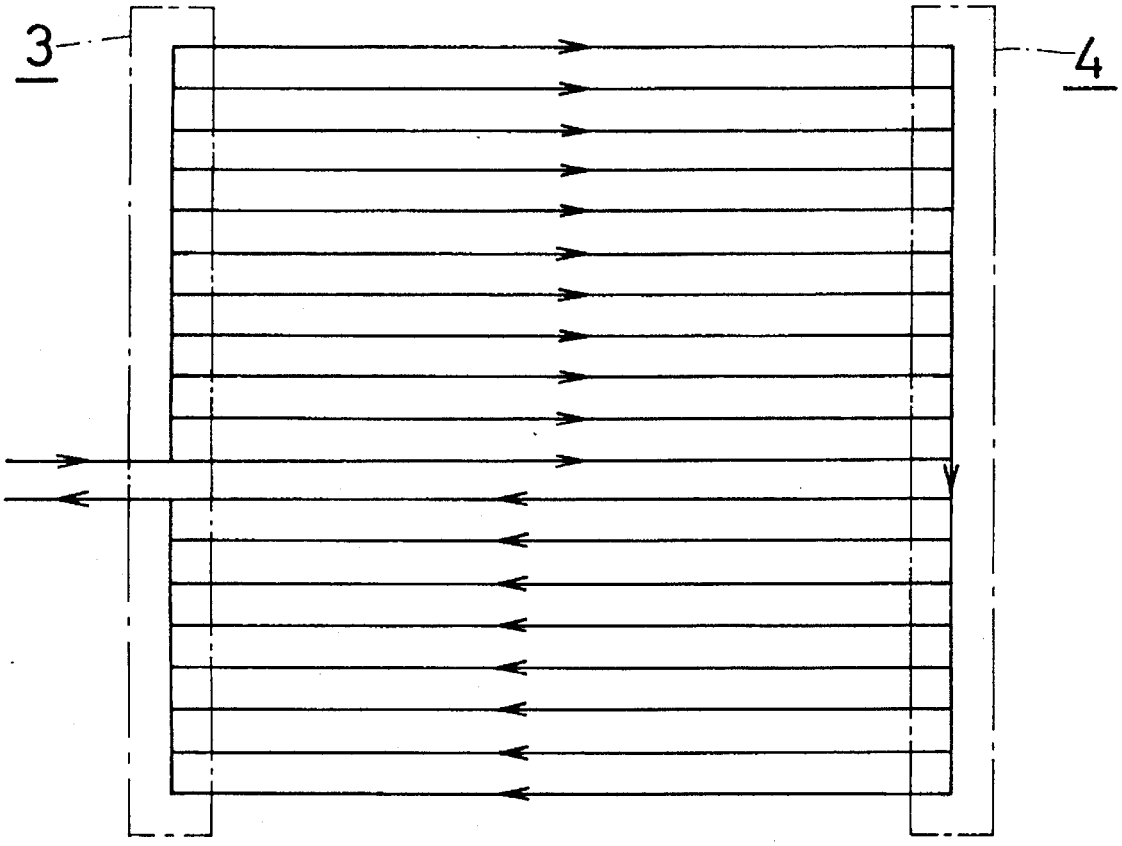

In the condenser described above, the heat exchanging medium will enter the upper compartment of the left-hand header 3, through the upper port 22 of the joint 20 as illustrated in FIGS. 1 and 7. Subsequently, the medium will flow through the upper group of the tubes 1 and then advance into the right-hand header 4. The heat exchanging medium which has entered the right-hand header will make therein a U-turn, before returning towards the left-hand header 3 through the lower group of the other tubes 1. Finally, the medium collected in the lower compartment of the left-hand header will leave this condenser through the lower port 23 of said joint 20.

During this process, the medium condenses due to heat exchange occurring between it and air streams, which penetrate paths each defined between the adjacent tubes 1 and including the corrugated fin 2.

The described condenser is of the so-called multi-flow type through which the medium meanders. It will be advantageous for a better performance that the cross-sectional area of the downstream group of tubes is made lesser than that of the upstream one. Such a condenser is proposed in the U.S. Pat. No. 5,190,100 issued to Hoshino et al. on Mar. 2, 1993, the teachings of which are incorporated by reference.

Any inlet or outlet pipe for the heat exchanging medium need no longer be connected directly to the header or headers in the condenser designed herein. Therefore, a space available for the condenser mounted on an automobile body can now be utilized to a maximum extent, thereby increasing its heat exchanging capacity to a remarkable degree. It is not necessary to worry about the layout of the inlet and/or outlet pipes, so that design and manufacture of the relevant parts becomes much simpler.

The external piping 32 from a compressor as well as the other piping 33 leading to a expansion valve can easily be secured to the condenser by attaching the connectors 34 of flange connection type to the ends of those pipings, arranging the connectors on the joint 20 of the condenser, and then bolting them thereto. This joint 20 also of flange connection type enables such a simplified efficient operation for fixing in place those external pipings by means of the bolts.

Since both the ports 22 and 23 for the inlet and outlet of the heat exchanging medium are formed in the common joint 20, connection of the external pipings 32 and 33 to the condenser can be done at the same location, very easily and rapidly. The number of parts and connections is reduced, thus lowering the possibility of leakage of the medium out of the connected portions. The ports 22 and 23 disposed on the same flat side 21*a* of the common joint will contribute to further make easy and efficient the connecting operation.

Second Embodiment

FIGS. 8 to 13 show a second embodiment of the invention, in which a condenser as another example of heat exchangers made of aluminum and being of the multi-flow type is provided for use in the car air conditioners.

The heat exchanger body "B" in this embodiment is similar to that "A" in the first embodiment, but differs from it in the structure of headers, the structure and position of a partition.

A pipe 105 as a main part of each header 103 or 104 in the heat exchanger body "B" is composed of halves 105*a* and 105*b*. One of the halves 105*a* faces the tubes, and the other half 105*b* opposite thereto has longitudinal edges which abut against and are brazed to those of the complementary half 105*a*. Both the halves 105*a* and 105*b* are made of an aluminum brazing sheet composed of a core having its sides covered with a brazing agent layer. However, the headers 3 and 4 in the first embodiment may substitute for such composite headers 103 and 104, if so desired.

Figure 12:
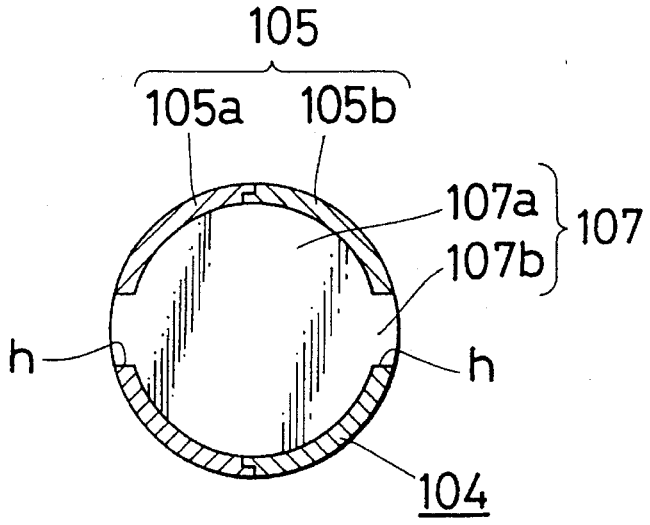

The partition 107 comprises, as illustrated in FIG. 12, a main part 107*a* tightly fittable in the header and two ears 107*b* integral with and protruding from opposite sides of main part. This partition 107 is secured in the right-hand header 104, at its position a little lower than middle height. These ears 107*b* are inserted in and brazed to horizontal slots "h" which are formed in the periphery of the halves 105*a* and 105*b* of header pipe. Preferably, the partition 107, which may be replaced with that 7 in the first embodiment, is also made of the brazing sheet.

Since other structural features of this heat exchanger body "B" is the same as that "A" in the first embodiment, those members which are denoted by the same numerals are not described here.

A joint 120 is attached to the outer peripheral portion of the right-hand header 104, in such a position as to cover an exposed edge of the partition 107. A single female-threaded bore 24 is formed through the joint 120, between two ports 22 and 23. Other features are the same as that in the first embodiment, so that description of those members denoted by the corresponding numerals is not repeated here. The number or position of the threaded bore(s) may be altered, if necessary. Seats 30 used to attach the joint 120 to the header are also the same as those in the first embodiment, description of the seats and relevant members denoted by the corresponding numerals is not repeated.

Figure 8:
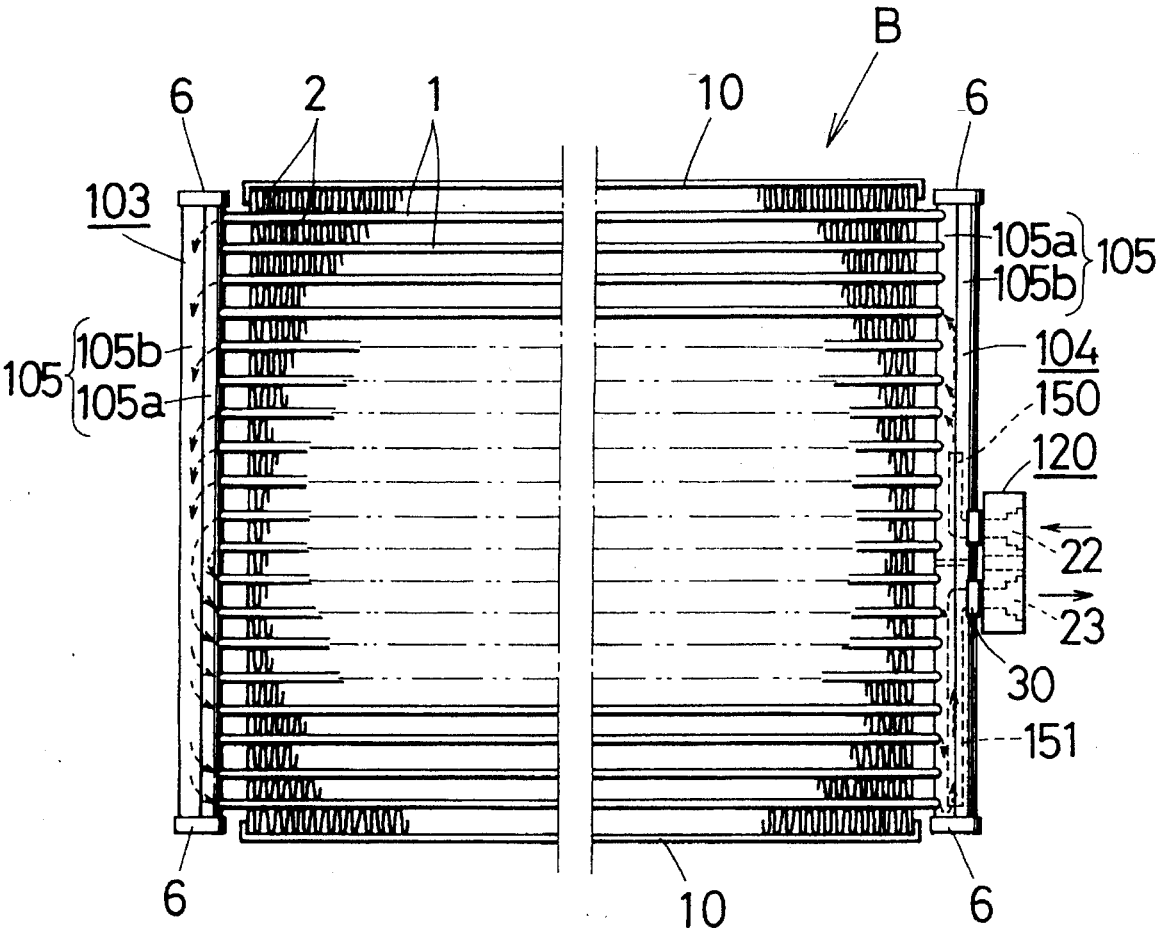
Figure 9:
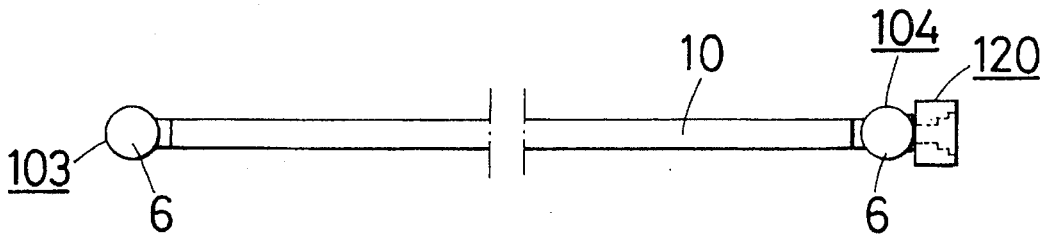
Figure 10:
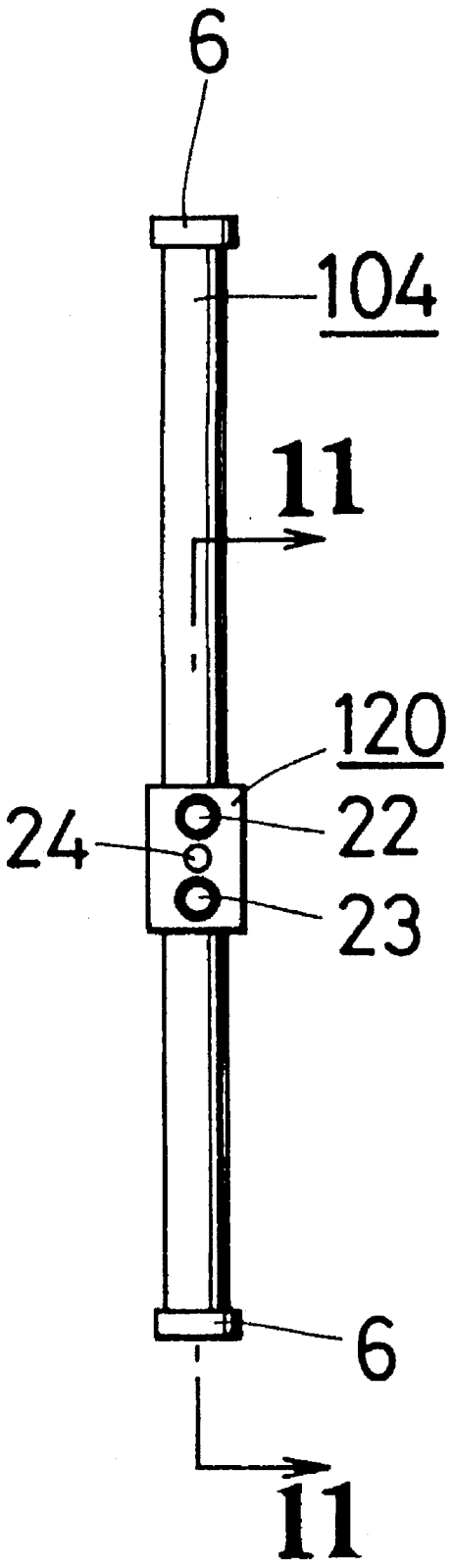
Figure 11:
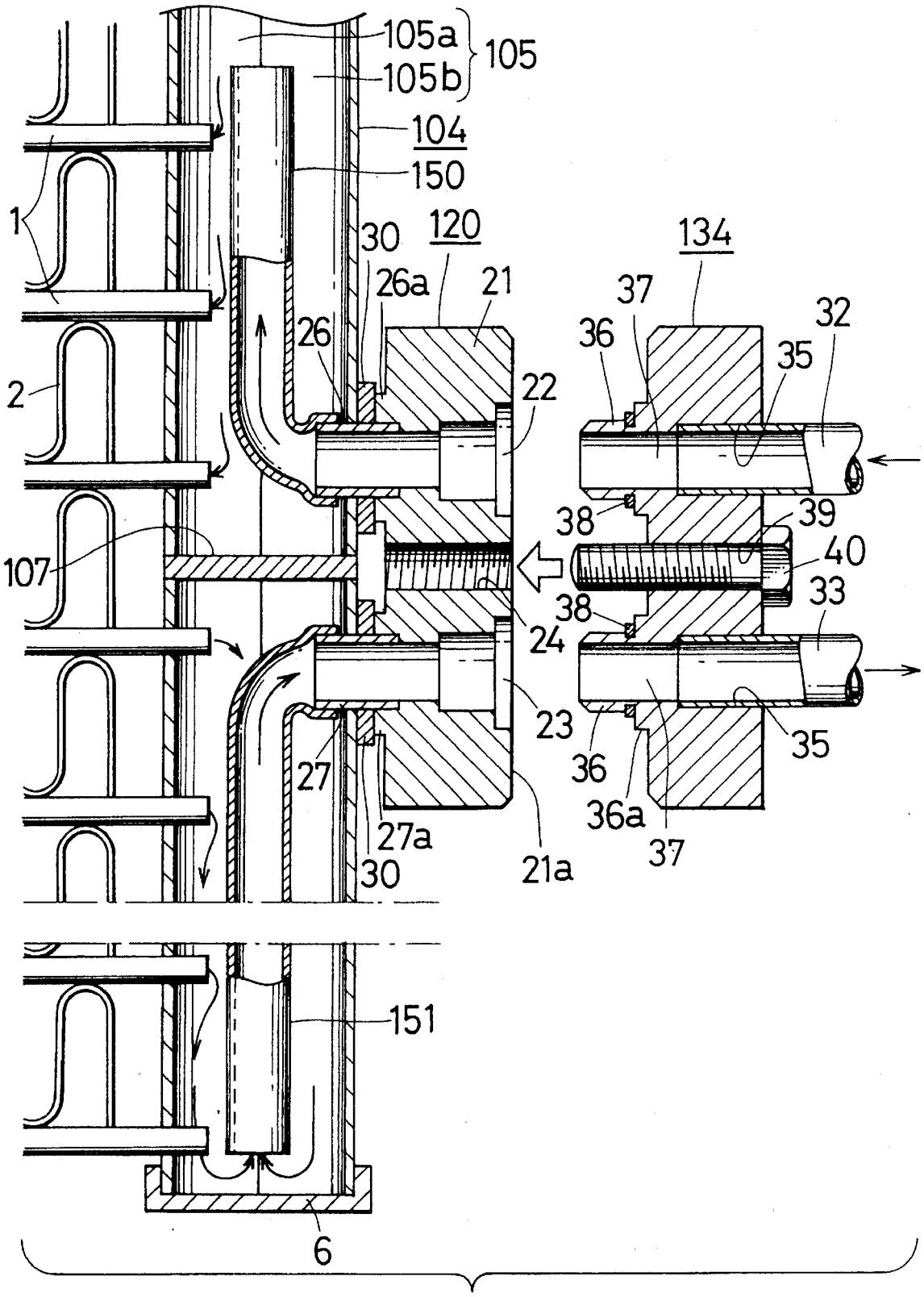

A short inlet pipe 26 integral with the joint 120 has, as shown in FIGS. 8 and 11, an inner end connected to an upward internal pipe 150 accommodated in the header 104. A short outlet pipe 27 integral with the joint 120 has an inner end connected to a downward internal pipe 151 accommodated in the header 104. The internal pipes 150 and 151 will be connected to the joint 120 engaging with the outer half 105*b*, without any difficulty before uniting the outer half with the inner half 105*a*.

Ends of external pipings 32 and 33 may be fixed in a common connector 134 of flange connection tyep so as to be attached to the joint 120.

This connector 134 is a one-piece fabricated aluminum block, and has at one of its opposite sides a pair of receiving ports 35 in which the ends of external pipings 32 and 33 are inserted. Short cylindrical protrusions 36, which are integral with and extend from the other side of the connector towards the joint, are spaced an appropriate distance from one another. Since other details are the same as the first embodiment, description thereof is abbreviated, only allotting the same numerals to the corresponding members and portions.

A non-threaded bore 39 penetrates the connector 134 so as to receive a bolt 40. This bolt is screwed into the threaded bore 24 of the joint 120 attached to the header so that the connector 134 fixed on the ends of external pipings is secured to this joint.

Figure 13:
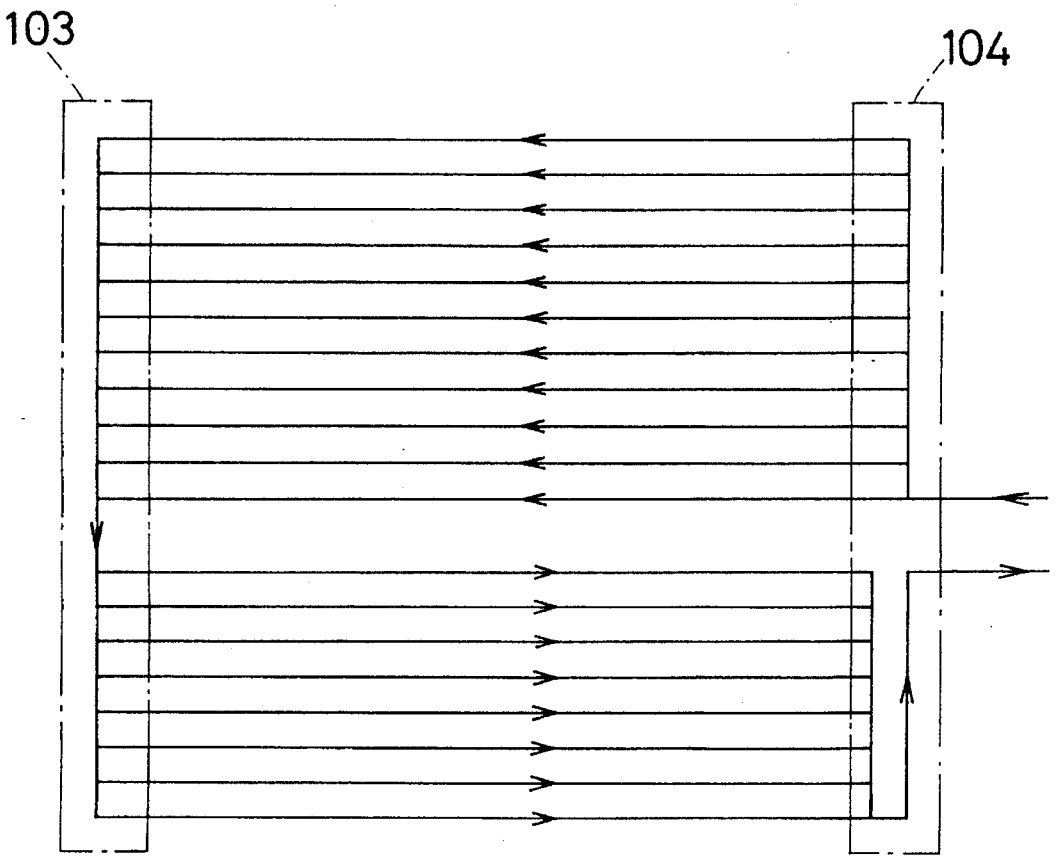

Also in the condenser described above, a heat exchanging medium will enter the upper compartment of the right-hand header 104, through the upper port 22 of the joint 120 and then through the upward internal pipe 150 as shown in FIGS. 8 and 13. This internal pipe 150 within the header prevents the heat exchanging medium from flowing unevenly and excessively through the tubes 1 located lower in the upper group. The medium will thus advance evenly through the tubes 1 in this group and enter the left-hand header 103. Subsequently, the medium will make a U-turn in the left-hand header, before returning to the right-hand header 104 through the lower group of tubes 1. Finally, the medium collected in the lower compartment of the right-hand header 104 flows out of this condenser through the downward internal pipe 151 and the lower port 23 of the joint 120. This pipe 151 sucks up a liquefied fraction of the medium, lest it should stay on the bottom of the header.

During this process, the medium condenses due to heat exchange occurring between it and air streams, which penetrate paths each defined between the adjacent tubes 1 and including the corrugated fin 2.

The single and common connector 134 for both the external pipings further simplifies their connection to the joint 120.

Third Embodiment

Figure 14:
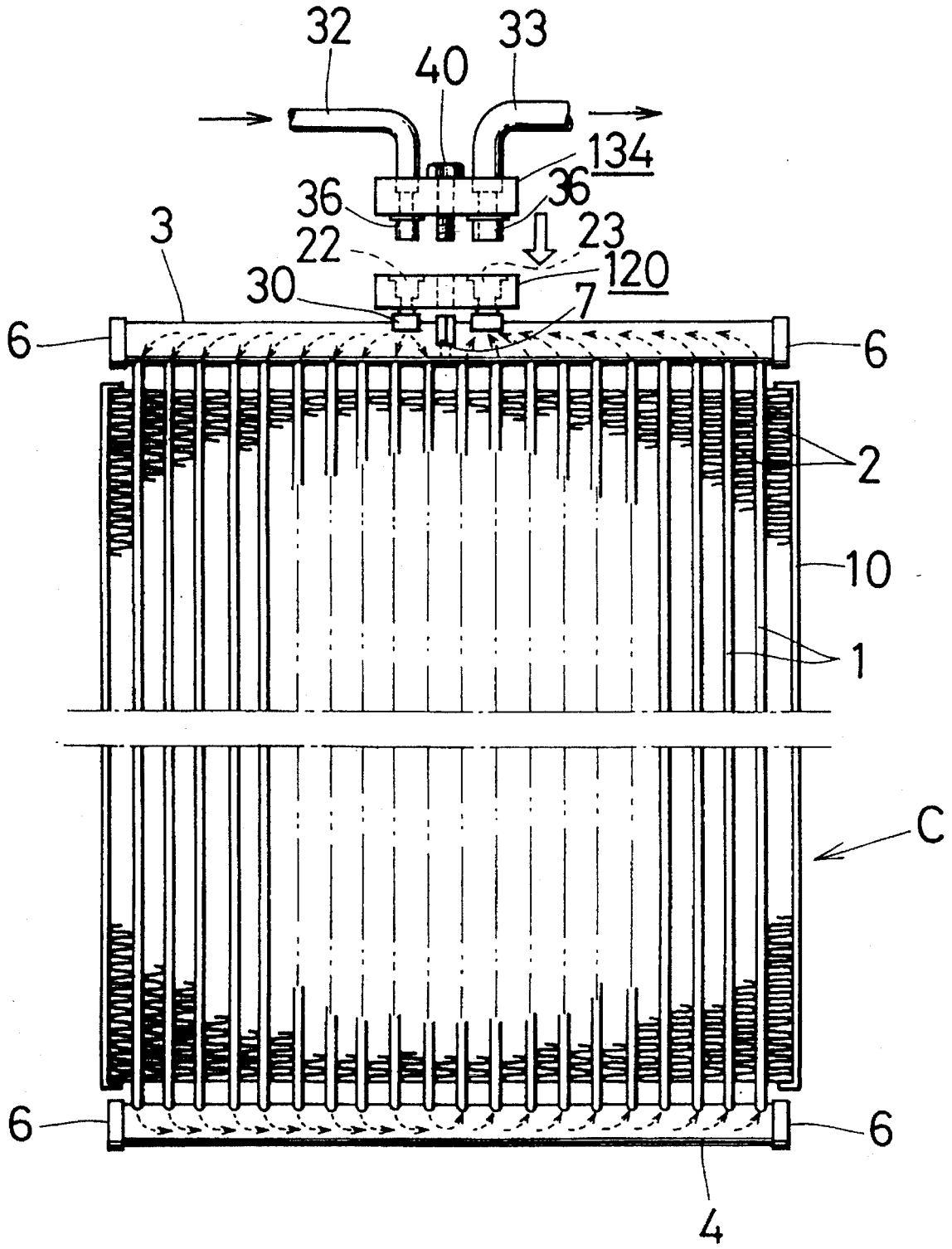
FIG. 14 is a front elevation of a heat exchanger as a whole provided in a third second embodiment.

FIG. 14 illustrates a third embodiment of the invention, in which an evaporator as a further example of heat exchangers made of aluminum and being of the multi-flow type is provided for use in the car air conditioners.

A heat exchanger body "C" in this embodiment, headers 3 and 4 extend horizontally, and a partition 7 in the upper one 3 is secured at a middle position thereof. Description of other structural features which are the same as the first embodiment and denoted by the corresponding reference numerals is abbreviated.

Fixed to an upper peripheral portion of upper header 3 is a joint 120 which is positioned to cover the partition 7. Since details of this joint 120 and a seat 30 therefor are the same as the second embodiment, no description is given for those members or portions which are denoted by the corresponding numerals.

A connector 134 of flange connection type and attached to ends of external pipings 32 and 33 is connected to the joint 120. Also, details of this connector 134 of the same structure as the second embodiment is not described in any detail, but allotting the same numerals to the corresponding portions.

One of the external pipings 33 for discharging a heat exchanging medium is made larger in internal diameter than the other piping 32 for feeding it, in order that pressure loss of the medium is diminished in spite of a change in phase thereof.

In operation, the heat exchanging medium will enter a left-hand compartment of the upper header 3, through the left-hand port 22 of the joint 120. The medium will then advance through a left-hand group of the tubes 1 and enter the lower header 4, in which header the medium makes a U-turn before flowing upwards into a right-hand group of the tubes 1. The medium thus collected in a right-hand compartment of the upper header 3 will leave this evaporator through the right-hand port 23 of the joint 120.

During this process, the medium evaporates due to heat exchange occurring between it and air streams, which penetrate paths each defined between the adjacent tubes 1 and including the corrugated fin 2.

The single and common connector 134 for both the external pipings 32 and 33 enables one-shot operation in connecting them to the joint 120, in a manner similar to the second embodiment.

Fourth Embodiment

Figure 15:
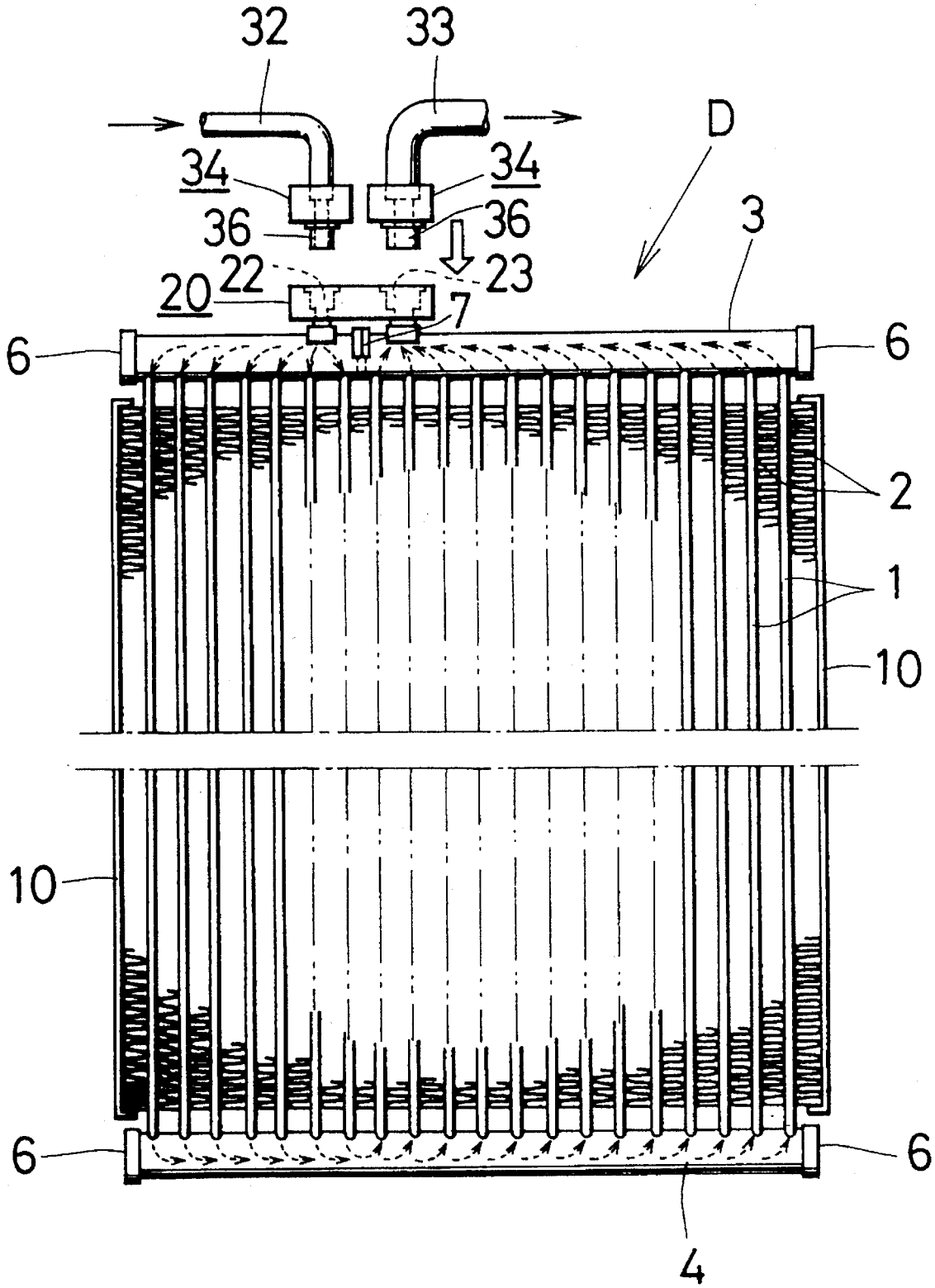
FIG. 15 is a front elevation of another heat exchanger as a whole provided in a fourth embodiment.
Figure 16:
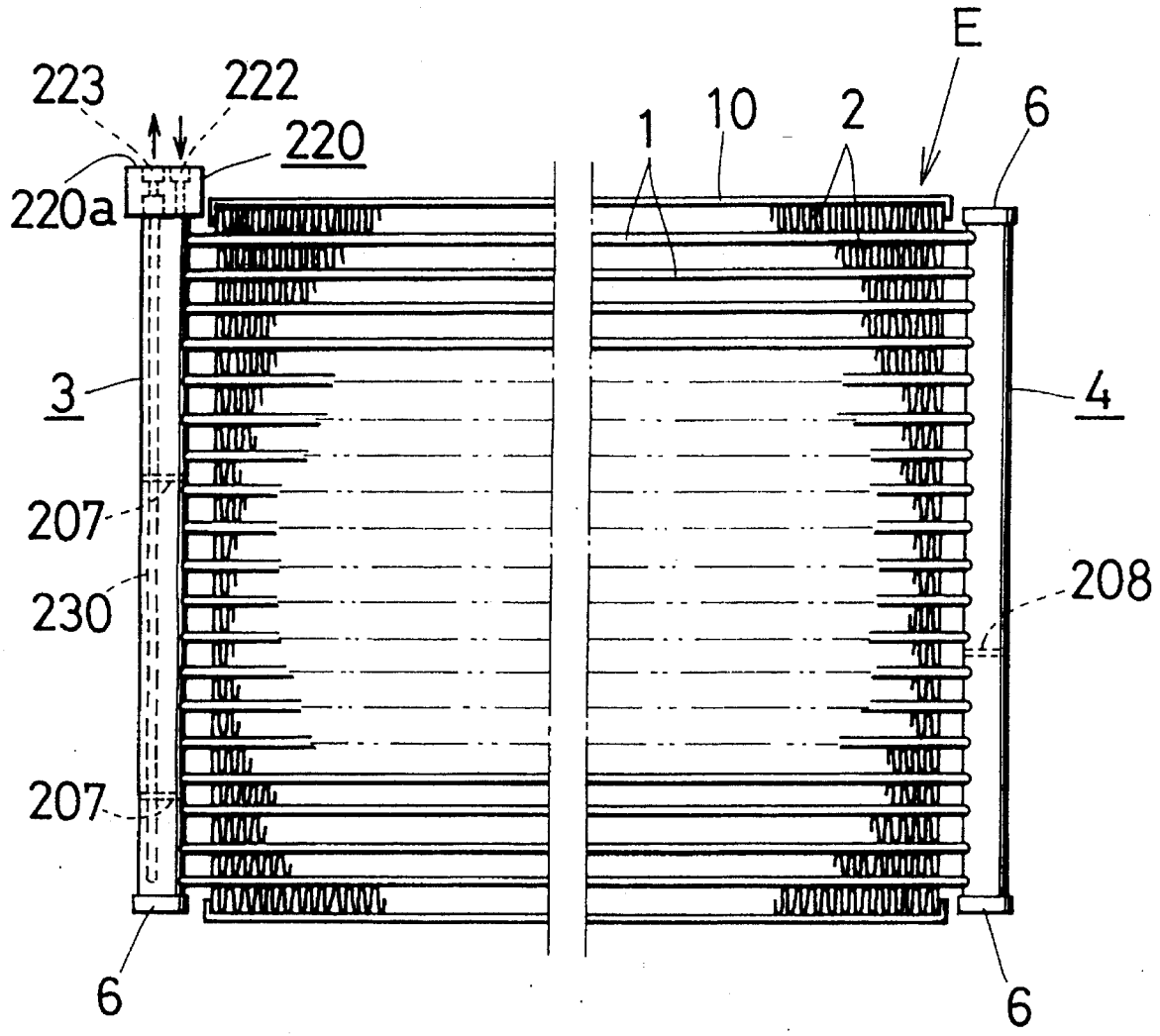
Figure 17:
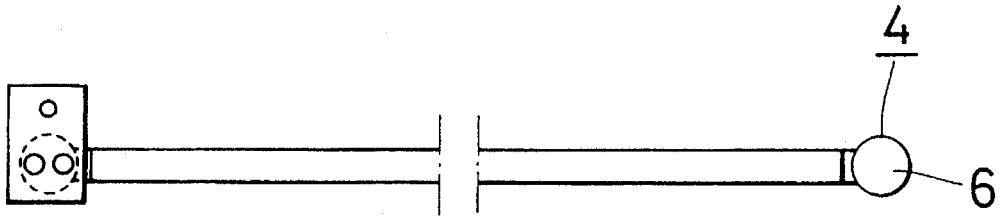
Figure 18:
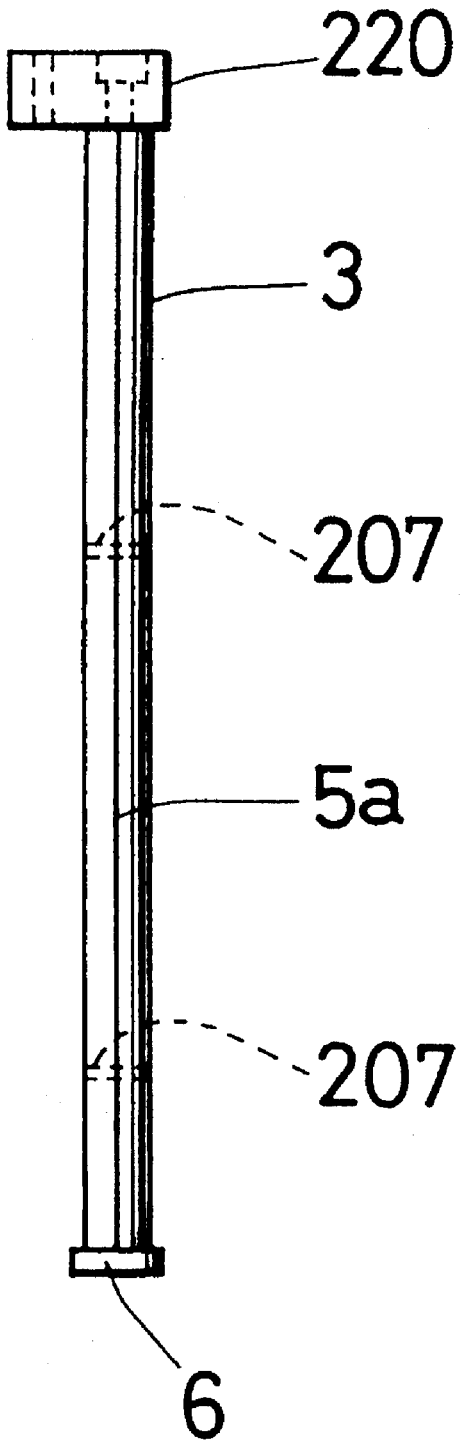

FIG. 15 shows a further embodiment of the invention, in which an evaporator made of aluminum and being of the multi-flow type is provided for use in the car air conditioners.

A heat exchanger body "D" in this embodiment does not differ from that in the third embodiment, except for its partition is offset leftwards, i.e., to an upstream side of the header. Description of other structural features which are the same as the first embodiment and denoted by the corresponding reference numerals is abbreviated.

Since details of a joint 20 attached to the body "D" and connectors 34 coupled with the joint are the same as the first embodiment, no description is repeated for those members or portions which are denoted by the corresponding numerals.

An overall cross-sectional area of the downstream passages for a heat exchanging medium is made greater than that of the upstream ones in this evaporator, in order that pressure loss of the medium is diminished in spite of a change in phase thereof.

Fifth Embodiment

FIGS. 16 to 22 show a still further embodiment of the invention, in which a condenser made of aluminum and also being of the multi-flow type is provided for use in the car air conditioners.

A heat exchanger body "E" in this embodiment does not differ from that in the first embodiment, except for the structure and position of its partition. Description of other structural features, which are the same as the first embodiment and denoted by the corresponding numerals, is not repeated.

The space within left-hand header 3 is divided by an upper and lower partitions 207 into three chambers, i.e., a top, a middle and a bottom compartments. On the other hand, a partition 208 dividing the interior of the right-hand header 4 into an upper and lower compartments is secured in this header at a height located between the two partitions in the left-hand header. A blockish joint 220, which is of flange connection type and serves as a cap for an upper end of the left-hand header 3, is brazed to the upper end in fluid communication therewith.

The joint 220 is an integral block made of aluminum, and substantially is a rectangular parallelepiped having a flat upper side 220*a* for flange connection. An inlet port 222 and an outlet port 223 for a heat exchanging medium are formed on the flat side 220*a*.

A downward internal pipe 230 descending from the joint 220 is in fluid communication with the outlet port 223 thereof and penetrates the two partitions 207. A bottom of this internal pipe 230 is disposed in the bottom compartment in the left-hand header.

Figure 19:
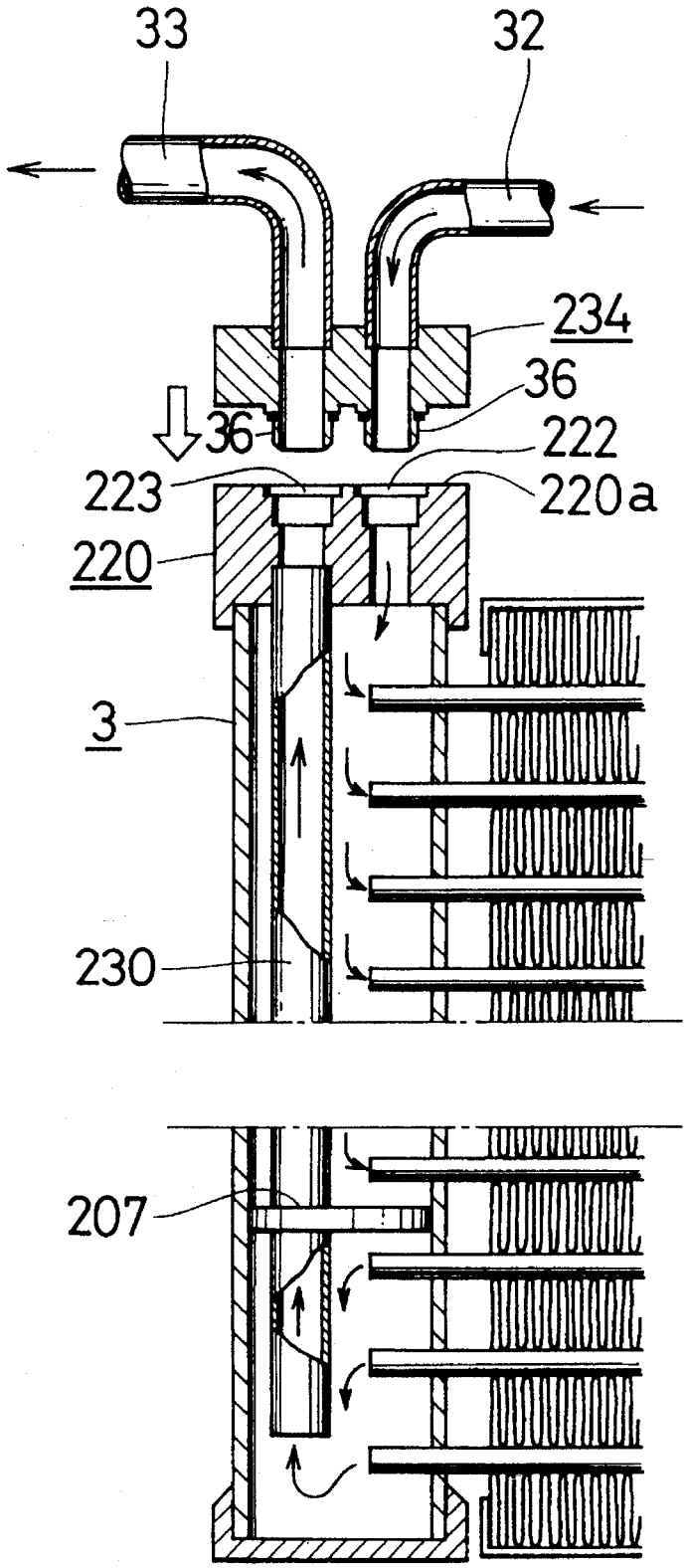
Figure 20:
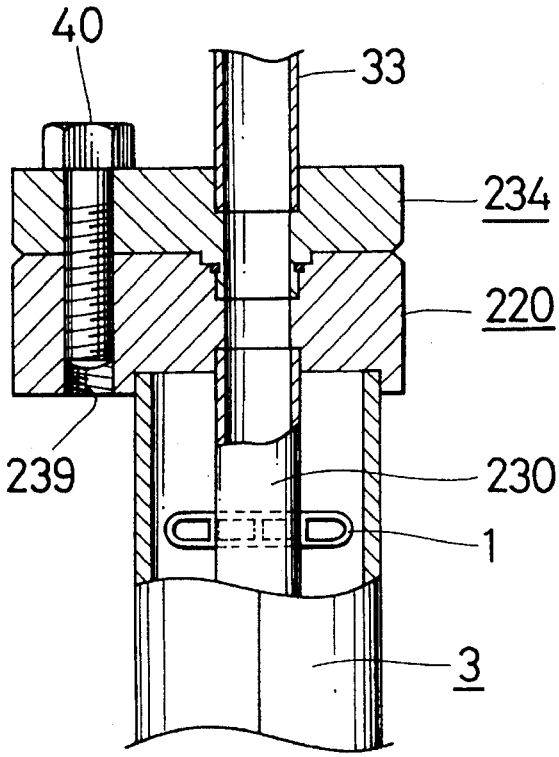

As is shown in FIG. 19, external pipings 32 and 33 are fixed to the joint 220 by means of a connector 234. This 234 also is a one-piece aluminum block of flange connection type and attached to the ends of those external pipings. Since similarly to that in the first embodiment, cylindrical protrusions 36 extend from the connector 234 likewise bolted to the joint 220 by means of the bolt 40, the other features are not detailed here.

The heat exchanging medium flows through the inlet port 222 into the top compartment of the left-hand header 3, and subsequently meanders through the groups of tubes 1, until entering the bottom compartment of said header 3 so as to be discharged out of this condenser through the internal pipe 230 and the outlet port 223 of the joint 220.

Figure 21:
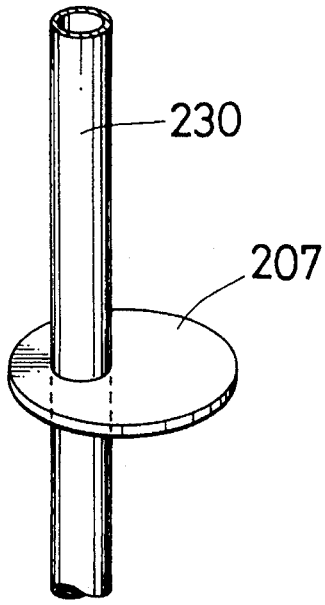
Figure 22:
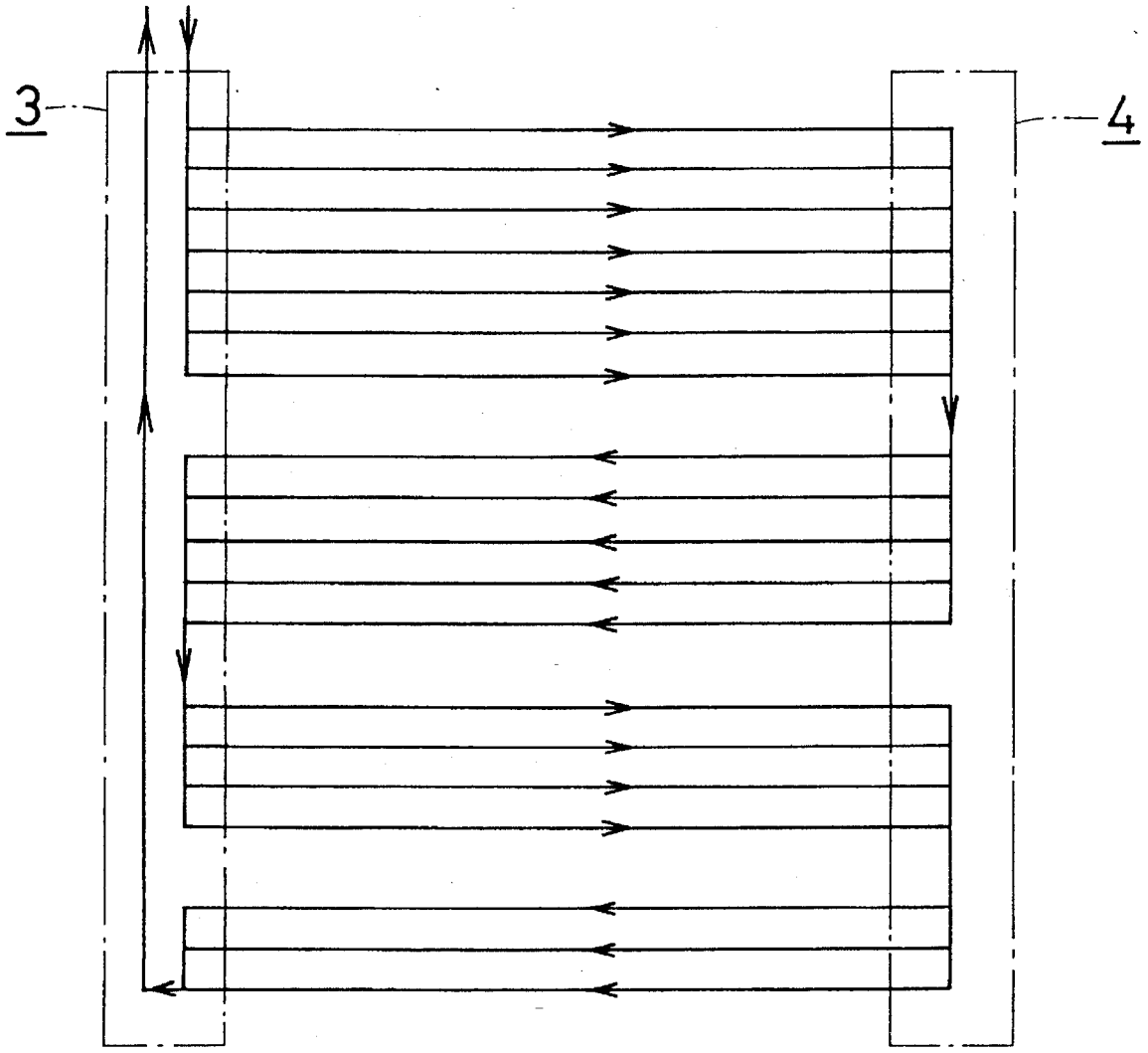

As is shown in FIG. 21, in fabricating this heat exchanger, the disc-shaped partitions 207 may be fitted on the internal pipe 230 at its predetermined heights and then inserted in the header 3 through its open end, along with the pipe. These members will then be one-shot brazed to become integral with one another.

In addition to advantages similar to those in the preceding embodiments, a further advantage inherent in this embodiment is the increased number of U-turns which the medium makes for an improved efficiency of heat exchange.

It will be understood that the present invention is applicable to heat exchangers of various types such as the condenser or evaporator in room air conditioners, a radiator and an oil cooler which in common comprise headers of the described type. The term "aluminum" used herein is meant to include aluminum alloys.

What is claimed is:

1. A heat exchanger comprising:

a plurality of tubes;

at least one hollow header to which an end of each tube is connected in fluid communication therewith;

a blockish joint having a flat side for a flange connection;

an inlet port and an outlet port both formed in the flat side for flowing a heat exchanging medium, wherein the joint is attached to the header in fluid communication therewith;

at least one partition secured in the header transversely of the header to divide the interior thereof;

a pair of insertable short pipes protruding from another side opposite the flat side formed with the ports, with one of the short pipes for the heat exchanging medium being in fluid communication with the inlet port by an internal passage, and with the other short pipe being in fluid communication with the outlet port through another internal passage; and a pair of openings for the short pipes, said openings being formed in a periphery of the header at two positions thereof on opposite sides of the partition and proximate the partition, wherein the short pipes are inserted in and brazed to the corresponding openings so as to fix the joint to the header in fluid communication therewith; the partition and the joint being separate members.

2. A heat exchanger as defined in claim 1, further comprising at least one seat, wherein the seat has a concave side fittable on the periphery of the header and at least one hole for receiving the short pipe, and wherein the seat is interposed between and brazed to the periphery of the header and the joint, with the short pipes inserted in the openings.

3. A heat exchanger as defined in claim 2, wherein the seat is made of a material which is composed of a core having both sides thereof covered with a brazing agent layer.

4. A heat exchanger as defined in claim 1, wherein the joint has at least one threaded bore by which at least one connector attached to ends of external pipings is fastened to the joint.

5. A heat exchanger as defined in claim 4, blockish joint comprises: a receiving port which liquid-tightly receives the external piping; a cylindrical protrusion fittable in the inlet port or outlet port of the joint, with the protrusion communicating with the corresponding port via internal passage; and at least one hole for insertion of a fastening member.

6. A heat exchanger as defined in claim 4, wherein the connector is a one-piece fabricated article to which both the external pipings are connected in common.

7. A heat exchanger as defined in claim 4, wherein the connectors are independent articles to which the external pipings are connected separate from one another.

8. A heat exchanger as defined in claim 1, further comprising internal pipes which are connected to the corresponding insertable short pipes of the joint, and are inserted in and extend longitudinally of the header.

9. A heat exchanger as defined in claim 1, wherein each of the headers comprises a header pipe and caps closing ends thereof, with the header pipe composed of halves one of which face the tubes, and with the other half disposed opposite thereto.

10. A heat exchanger as defined in claim 1, wherein the headers are disposed horizontally.

11. A heat exchanger comprising:

a plurality of tubes arranged in parallel with each other;

hollow headers to which ends of each tube are connected in fluid communication therewith;

at least one partition secured in at least one of the headers transversely of the header to divide the interior thereof;

a blockish joint attached to one of the headers;

the joint having:

a flat side for flange connection;

an inlet port and an outlet port both formed in the flat side for flowing a heat exchanging medium; and insertable short pipes protruding from another side opposite to the flat side formed with the ports, with one of the short pipes for flowing the medium being in fluid communication with the inlet port through an internal passage, whereas the other short pipe communicates with the outlet port through another internal passage; and a pair of openings for short pipes and formed in a periphery of the header at two positions thereof on opposite sides of the partition and proximate the partition, wherein the short pipes are inserted in and brazed to the corresponding openings so as to fix the joint to the header in fluid communication therewith; the partition and the joint being separate members 12. A heat exchanger comprising:

a plurality of tubes arranged in parallel with each other;

a plurality of fins each interposed between the adjacent tubes;

a pair of hollow headers to which corresponding ends the tubes are connected in fluid communication;

at least one partition secured in at least one of the headers transversely of the header to divide the interior thereof;

a blockish joint attached to one of the headers;

the joint having:

a flat side for flange connection;

an inlet port and an outlet port both formed in the flat side for flowing a heat exchanging medium; and insertable short pipes protruding from another side opposite to the flat side formed with the ports, with one of the short pipes for flowing the medium being in fluid communication with the corresponding inlet and outlet ports respectively through internal passages;

a pair of openings for short pipes and formed in a periphery of the header at two positions thereof on opposite sides of the partition and proximate the partition, wherein the short pipes are inserted in and brazed to the corresponding openings so as to fix the joint to the header in fluid communication therewith; and at least one seat which has a concave side fittable on the periphery of the header and at least one holes each for receiving the short pipe, wherein the seat is interposed between and brazed to the periphery of the header and the joint, with the short pipes inserted in the openings; the partition and the joint being separate members 13. A heat exchanger as defined in claim 12, wherein the joint has at least one threaded bore by which at least one connector attached to ends of external pipings is fastened to the joint, and the heat exchanger further comprising at least one connector which is blockish and of flange connection type, wherein the connector or connectors comprise:

receiving ports which liquid-tightly receive the external piping; cylindrical protrusions fittable in the inlet port and outlet port of the joint, with the protrusions being in fluid communication with the corresponding ports via internal passages, respectively; and at least one hole for insertion of a fastening member such as a bolt so that the fastening member is fastened to the threaded hole in the joint whereby the connector or connectors are secured to thereto.

14. A heat exchanger as defined in claim 13, wherein the connector is a one-piece fabricated article to which both the external pipings are connected in common.

15. A heat exchanger as defined in claim 13, wherein the connectors are independent articles to which the external pipings are connected separate from one another.

16. A heat exchanger as defined in claim 12, wherein the headers are disposed up and down and in parallel with each other.

* * * * *